US008674274B2

(12) United States Patent
Parsche

(10) Patent No.: US 8,674,274 B2
(45) Date of Patent: Mar. 18, 2014

(54) APPARATUS AND METHOD FOR HEATING MATERIAL BY ADJUSTABLE MODE RF HEATING ANTENNA ARRAY

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 1047 days.

(21) Appl. No.: 12/395,945

(22) Filed: Mar. 2, 2009

(65) Prior Publication Data

US 2010/0219182 A1 Sep. 2, 2010

(51) Int. Cl.
*H05B 6/04* (2006.01)
*H05B 6/02* (2006.01)

(52) U.S. Cl.
USPC ..... 219/660; 219/411; 219/764; 219/778

(58) Field of Classification Search
CPC ..... H05B 1/00; H05B 6/04; H05B 6/062; H05B 6/72; H05B 6/701; H05B 6/705; H05B 6/707; Y02B 40/143; Y02B 40/146
USPC ..... 219/411, 764, 778
See application file for complete search history.

(56) References Cited

U.S. PATENT DOCUMENTS 2,371,459 A * 3/1945 Mittelmann ..... 148/573
2,411,198 A * 11/1946 Eltgroth ..... 342/417
2,685,930 A 8/1954 Albaugh
2,756,313 A * 7/1956 Cater ..... 219/670
2,871,477 A * 1/1959 Hatkin ..... 343/728
2,947,841 A * 8/1960 Pickles et al. ..... 219/644
3,497,005 A 2/1970 Pelopsky
3,848,671 A 11/1974 Kern
3,954,140 A 5/1976 Hendrick
3,988,036 A 10/1976 Fisher
3,991,091 A 11/1976 Driscoll (Continued)

FOREIGN PATENT DOCUMENTS

CA 1199573 A1 1/1986
CA 2678473 8/2009

(Continued)

OTHER PUBLICATIONS

U.S. Appl. No. 12/886,338, filed Sep. 20, 2010 (unpublished).

(Continued)

*Primary Examiner* — Dana Ross
*Assistant Examiner* — Brett Spurlock
(74) *Attorney, Agent, or Firm* — Allen, Dyer, Doppelt, Milbrath & Gilchrist, P.A.

(57) ABSTRACT

An apparatus for heating a material that is susceptible to RF heating by an RF antenna array. The apparatus includes a source of RF power connected to an antenna array having a plurality of loop antenna sections connected to each other by dipole antenna sections wherein the loop antenna sections and dipole antenna sections create a magnetic near field and an electric near field such that the ratio of magnetic field strength to electric field strength is approximately a predetermined value. Material is heated by the apparatus by placing the material in the near fields of the antenna array and creating magnetic near fields and electric near fields that approximate a ratio that is predetermined to efficiently heat the material and connecting the antenna array to an RF power source.

7 Claims, 3 Drawing Sheets

(56) References Cited

U.S. PATENT DOCUMENTS

| | | | | |
|---|---|---|---|---|
| 4,035,282 | A | 7/1977 | Stuchberry et al. | |
| 4,042,487 | A | 8/1977 | Seguchi | |
| 4,087,781 | A | 5/1978 | Grossi et al. | |
| 4,136,014 | A | 1/1979 | Vermeulen | |
| 4,140,179 | A | 2/1979 | Kasevich et al. | |
| 4,140,180 | A | 2/1979 | Bridges et al. | |
| 4,144,935 | A | 3/1979 | Bridges et al. | |
| 4,146,125 | A | 3/1979 | Sanford et al. | |
| 4,196,329 | A | 4/1980 | Rowland et al. | |
| 4,295,880 | A | 10/1981 | Horner | |
| 4,300,219 | A | 11/1981 | Joyal | |
| 4,301,865 | A | 11/1981 | Kasevich et al. | |
| 4,303,021 | A | 12/1981 | Bourlier | |
| 4,328,324 | A | 5/1982 | Kock | |
| 4,373,581 | A | 2/1983 | Toellner | |
| 4,396,062 | A | 8/1983 | Iskander | |
| 4,404,123 | A | 9/1983 | Chu | |
| 4,410,216 | A | 10/1983 | Allen | |
| 4,425,227 | A | 1/1984 | Smith | |
| 4,449,585 | A | 5/1984 | Bridges et al. | |
| 4,456,065 | A | 6/1984 | Heim | |
| 4,457,365 | A | 7/1984 | Kasevich et al. | |
| 4,470,459 | A | 9/1984 | Copland | |
| 4,485,869 | A | 12/1984 | Sresty | |
| 4,487,257 | A | 12/1984 | Dauphine | |
| 4,508,168 | A | 4/1985 | Heeren | |
| 4,514,305 | A | 4/1985 | Filby | |
| 4,524,827 | A | 6/1985 | Bridges | |
| 4,531,468 | A | 7/1985 | Simon | |
| 4,583,586 | A | 4/1986 | Fujimoto et al. | |
| 4,620,593 | A | 11/1986 | Haagensen | |
| 4,622,496 | A | 11/1986 | Dattili | |
| 4,645,585 | A | 2/1987 | White | |
| 4,678,034 | A | 7/1987 | Eastlund | |
| 4,703,433 | A | 10/1987 | Sharrit | |
| 4,790,375 | A | 12/1988 | Bridges | |
| 4,817,711 | A | 4/1989 | Jeambey | |
| 4,882,984 | A | 11/1989 | Eves, II | |
| 4,892,782 | A | 1/1990 | Fisher et al. | |
| 5,046,559 | A | 9/1991 | Glandt | |
| 5,055,180 | A | 10/1991 | Klaila | |
| 5,065,819 | A | 11/1991 | Kasevich | |
| 5,082,054 | A | 1/1992 | Kiamanesh | |
| 5,136,249 | A | 8/1992 | White | |
| 5,198,826 | A * | 3/1993 | Ito | 343/726 |
| 5,199,488 | A | 4/1993 | Kasevich | |
| 5,233,306 | A | 8/1993 | Misra | |
| 5,236,039 | A | 8/1993 | Edelstein | |
| 5,251,700 | A | 10/1993 | Nelson | |
| 5,293,936 | A | 3/1994 | Bridges | |
| 5,304,767 | A * | 4/1994 | McGaffigan et al. | 219/674 |
| 5,315,561 | A | 5/1994 | Grossi | |
| 5,370,477 | A | 12/1994 | Bunin | |
| 5,378,879 | A | 1/1995 | Monovoukas | |
| 5,506,592 | A | 4/1996 | MacDonald | |
| 5,582,854 | A | 12/1996 | Nosaka | |
| 5,621,844 | A | 4/1997 | Bridges | |
| 5,631,562 | A | 5/1997 | Cram | |
| 5,746,909 | A | 5/1998 | Calta | |
| 5,910,287 | A | 6/1999 | Cassin | |
| 5,923,299 | A | 7/1999 | Brown et al. | |
| 6,045,648 | A | 4/2000 | Palmgren et al. | |
| 6,046,464 | A | 4/2000 | Schetzina | |
| 6,055,213 | A | 4/2000 | Rubbo | |
| 6,063,338 | A | 5/2000 | Pham | |
| 6,097,262 | A | 8/2000 | Combellack | |
| 6,106,895 | A | 8/2000 | Usuki | |
| 6,112,273 | A | 8/2000 | Kau | |
| 6,184,427 | B1 | 2/2001 | Klepfer | |
| 6,229,603 | B1 | 5/2001 | Coassin | |
| 6,232,114 | B1 | 5/2001 | Coassin | |
| 6,301,088 | B1 | 10/2001 | Nakada | |
| 6,348,679 | B1 | 2/2002 | Ryan et al. | |
| 6,360,819 | B1 | 3/2002 | Vinegar | |
| 6,432,365 | B1 | 8/2002 | Levin | |
| 6,603,309 | B2 | 8/2003 | Forgang | |
| 6,613,678 | B1 | 9/2003 | Sakaguchi | |
| 6,614,059 | B1 | 9/2003 | Ban | |
| 6,649,888 | B2 | 11/2003 | Ryan et al. | |
| 6,712,136 | B2 | 3/2004 | de Rouffignac | |
| 6,808,935 | B2 | 10/2004 | Levin | |
| 6,923,273 | B2 | 8/2005 | Terry | |
| 6,932,155 | B2 | 8/2005 | Vinegar | |
| 6,967,589 | B1 | 11/2005 | Peters | |
| 6,992,630 | B2 | 1/2006 | Parsche | |
| 7,046,584 | B2 | 5/2006 | Sorrells | |
| 7,079,081 | B2 | 7/2006 | Parsche et al. | |
| 7,091,460 | B2 | 8/2006 | Kinzer | |
| 7,109,457 | B2 | 9/2006 | Kinzer | |
| 7,115,847 | B2 | 10/2006 | Kinzer | |
| 7,147,057 | B2 | 12/2006 | Steele | |
| 7,172,038 | B2 | 2/2007 | Terry | |
| 7,205,947 | B2 | 4/2007 | Parsche | |
| 7,312,428 | B2 * | 12/2007 | Kinzer | 219/772 |
| 7,322,416 | B2 | 1/2008 | Burris, II | |
| 7,337,980 | B2 | 3/2008 | Schaedel | |
| 7,438,807 | B2 | 10/2008 | Garner et al. | |
| 7,441,597 | B2 | 10/2008 | Kasevich | |
| 7,461,693 | B2 | 12/2008 | Considine et al. | |
| 7,484,561 | B2 | 2/2009 | Bridges | |
| 7,562,708 | B2 | 7/2009 | Cogliandro | |
| 7,623,804 | B2 | 11/2009 | Sone | |
| 2002/0032534 | A1 | 3/2002 | Regier | |
| 2004/0031731 | A1 | 2/2004 | Honeycutt | |
| 2005/0199386 | A1 | 9/2005 | Kinzer | |
| 2005/0274513 | A1 | 12/2005 | Schultz | |
| 2006/0038083 | A1 | 2/2006 | Criswell | |
| 2007/0108202 | A1 | 5/2007 | Kinzer | |
| 2007/0131591 | A1 | 6/2007 | Pringle | |
| 2007/0137852 | A1 | 6/2007 | Considine et al. | |
| 2007/0137858 | A1 | 6/2007 | Considine et al. | |
| 2007/0176842 | A1 * | 8/2007 | Brune et al. | 343/866 |
| 2007/0187089 | A1 | 8/2007 | Bridges | |
| 2007/0261844 | A1 | 11/2007 | Cogliandro et al. | |
| 2008/0073079 | A1 | 3/2008 | Tranquilla | |
| 2008/0143330 | A1 | 6/2008 | Madio | |
| 2009/0009410 | A1 | 1/2009 | Dolgin et al. | |
| 2009/0242196 | A1 | 10/2009 | Pao | |
| 2011/0248900 | A1 * | 10/2011 | de Rochemont | 343/803 |

FOREIGN PATENT DOCUMENTS

| | | | |
|---|---|---|---|
| DE | 10 2008 022176 | A1 | 11/2009 |
| EP | 0 135 966 | | 4/1985 |
| EP | 0418117 | A1 | 3/1991 |
| EP | 0563999 | | 10/1993 |
| EP | 1106672 | A1 | 6/2001 |
| FR | 1586066 | A | 2/1970 |
| FR | 2925519 | A1 | 6/2009 |
| JP | 56050119 | A | 5/1981 |
| JP | 2246502 | A | 10/1990 |
| WO | WO 2007/133461 | | 11/2007 |
| WO | 2008/011412 | A2 | 1/2008 |
| WO | WO 2008/030337 | | 3/2008 |
| WO | WO2008098850 | A1 | 8/2008 |
| WO | WO2009027262 | A1 | 8/2008 |
| WO | WO2009/114934 | A1 | 9/2009 |

OTHER PUBLICATIONS

Butler, R.M. "Theoretical Studies on the Gravity Drainage of Heavy Oil During In-Situ Steam Heating", Can J. Chem Eng, vol. 59, 1981.

Butler, R. and Mokrys, I., "A New Process (VAPEX) for Recovering Heavy Oils Using Hot Water and Hydrocarbon Vapour", Journal of Canadian Petroleum Technology, 30(1), 97-106, 1991.

Butler, R. and Mokrys, I., "Recovery of Heavy Oils Using Vapourized Hydrocarbon Solvents: Further Development of the VAPEX Process", Journal of Canadian Petroleum Technology, 32(6), 56-62, 1993.

Butler, R. and Mokrys, I., "Closed Loop Extraction Method for the Recovery of Heavy Oils and Bitumens Underlain by Aquifers: the VAPEX Process", Journal of Canadian Petroleum Technology, 37(4), 41-50, 1998.

(56) References Cited

OTHER PUBLICATIONS

Das, S.K. and Butler, R.M., "Extraction of Heavy Oil and Bitumen Using Solvents at Reservoir Pressure" CIM 95-118, presented at the CIM 1995 Annual Technical Conference in Calgary, Jun. 1995.
Das, S.K. and Butler, R.M., "Diffusion Coefficients of Propane and Butane in Peace River Bitumen" Canadian Journal of Chemical Engineering, 74, 988-989, Dec. 1996.
Das, S.K. and Butler, R.M., "Mechanism of the Vapour Extraction Process for Heavy Oil and Bitumen", Journal of Petroleum Science and Engineering, 21, 43-59, 1998.
Dunn, S.G., Nenniger, E. and Rajan, R., "A Study of Bitumen Recovery by Gravity Drainage Using Low Temperature Soluble Gas Injection", Canadian Journal of Chemical Engineering, 67, 978-991, Dec. 1989.
Frauenfeld, T., Lillico, D., Jossy, C., Vilcsak, G., Rabeeh, S. and Singh, S., "Evaluation of Partially Miscible Processes for Alberta Heavy Oil Reservoirs", Journal of Canadian Petroleum Technology, 37(4), 17-24, 1998.
Mokrys, I., and Butler, R., "In Situ Upgrading of Heavy Oils and Bitumen by Propane Deasphalting: The VAPEX Process", SPE 25452, presented at the SPE Production Operations Symposium held in Oklahoma City OK USA, Mar. 21-23, 1993.
Nenniger, J.E. and Dunn, S.G., "How Fast is Solvent Based Gravity Drainage?", CIPC 2008-139, presented at the Canadian International Petroleum Conference, held in Calgary, Alberta Canada, Jun. 17-19, 2008.
Nenniger, J.E. and Gunnewick, L., "Dew Point vs. Bubble Point: A Misunderstood Constraint on Gravity Drainage Processes", CIPC 2009-065, presented at the Canadian International Petroleum Conference, held in Calgary, Alberta Canada, Jun. 16-18, 2009.
Bridges, J.E., Sresty, G.C., Spencer, H.L. and Wattenbarger, R.A., "Electromagnetic Stimulation of Heavy Oil Wells", 1221-1232, Third International Conference on Heavy Oil Crude and Tar Sands, UNITAR/UNDP, Long Beach California, USA Jul. 22-31, 1985.
Carrizales, M.A., Lake, L.W. and Johns, R.T., "Production Improvement of Heavy Oil Recovery by Using Electromagnetic Heating", SPE115723, presented at the 2008 SPE Annual Technical Conference and Exhibition held in Denver, Colorado, USA, Sep. 21-24, 2008.
Carrizales, M. and Lake, L.W., "Two-Dimensional COMSOL Simulation of Heavy-Oil Recovery by Electromagnetic Heating", Proceedings of the COMSOL Conference Boston, 2009.
Chakma, A. and Jha, K.N., "Heavy-Oil Recovery from Thin Pay Zones by Electromagnetic Heating", SPE24817, presented at the 67th Annual Technical Conference and Exhibition of the Society of Petroleum Engineers held in Washington, DC, Oct. 4-7, 1992.
Chhetri, A.B. and Islam, M.R., "A Critical Review of Electromagnetic Heating for Enhanced Oil Recovery", Petroleum Science and Technology, 26(14), 1619-1631, 2008.
Chute, F.S., Vermeulen, F.E., Cervenan, M.R. and McVea, F.J., "Electrical Properties of Athabasca Oil Sands", Canadian Journal of Earth Science, 16, 2009-2021, 1979.
Davidson, R.J., "Electromagnetic Stimulation of Lloydminster Heavy Oil Reservoirs", Journal of Canadian Petroleum Technology, 34(4), 15-24, 1995.
Hu, Y., Jha, K.N. and Chakma, A., "Heavy-Oil Recovery from Thin Pay Zones by Electromagnetic Heating", Energy Sources, 21(1-2), 63-73, 1999.
Kasevich, R.S., Price, S.L., Faust, D.L. and Fontaine, M.F., "Pilot Testing of a Radio Frequency Heating System for Enhanced Oil Recovery from Diatomaceous Earth", SPE28619, presented at the SPE 69th Annual Technical Conference and Exhibition held in New Orleans LA, USA, Sep. 25-28, 1994.
Koolman, M., Huber, N., Diehl, D. and Wacker, B., "Electromagnetic Heating Method to Improve Steam Assisted Gravity Drainage", SPE117481, presented at the 2008 SPE International Thermal Operations and Heavy Oil Symposium held in Calgary, Alberta, Canada, Oct. 20-23, 2008.
Kovaleva, L.A., Nasyrov, N.M. and Khaidar, A.M., Mathematical Modelling of High-Frequency Electromagnetic Heating of the Bottom-Hole Area of Horizontal Oil Wells, Journal of Engineering Physics and Thermophysics, 77(6), 1184-1191, 2004.
McGee, B.C.W. and Donaldson, R.D., "Heat Transfer Fundamentals for Electro-thermal Heating of Oil Reservoirs", CIPC 2009-024, presented at the Canadian International Petroleum Conference, held in Calgary, Alberta, Canada Jun. 16-18, 2009.
Ovalles, C., Fonseca, A., Lara, A., Alvarado, V., Urrecheaga, K, Ranson, A. and Mendoza, H., "Opportunities of Downhole Dielectric Heating in Venezuela: Three Case Studies Involving Medium, Heavy and Extra-Heavy Crude Oil Reservoirs" SPE78980, presented at the 2002 SPE International Thermal Operations and Heavy Oil Symposium and International Horizontal Well Technology Conference held in Calgary, Alberta, Canada, Nov. 4-7, 2002.
Rice, S.A., Kok, A.L. and Neate, C.J., "A Test of the Electric Heating Process as a Means of Stimulating the Productivity of an Oil Well in the Schoonebeek Field", CIM 92-04 presented at the CIM 1992 Annual Technical Conference in Calgary, Jun. 7-10, 1992.
Sahni, A. and Kumar, M. "Electromagnetic Heating Methods for Heavy Oil Reservoirs", SPE62550, presented at the 2000 SPE/AAPG Western Regional Meeting held in Long Beach, California, Jun. 19-23, 2000.
Sayakhov, F.L., Kovaleva, L.A. and Nasyrov, N.M., "Special Features of Heat and Mass Exchange in the Face Zone of Boreholes upon Injection of a Solvent with a Simultaneous Electromagnetic Effect", Journal of Engineering Physics and Thermophysics, 71(1), 161-165, 1998.
Spencer, H.L., Bennett, K.A. and Bridges, J.E. "Application of the IITRI/Uentech Electromagnetic Stimulation Process to Canadian Heavy Oil Reservoirs" Paper 42, Fourth International Conference on Heavy Oil Crude and Tar Sands, UNITAR/UNDP, Edmonton, Alberta, Canada, Aug. 7-12, 1988.
Sresty, G.C., Dev, H., Snow, R.N. and Bridges, J.E., "Recovery of Bitumen from Tar Sand Deposits with the Radio Frequency Process", SPE Reservoir Engineering, 85-94, Jan. 1986.
Vermulen, F. and McGee, B.C.W., "In Situ Electromagnetic Heating for Hydrocarbon Recovery and Environmental Remediation", Journal of Canadian Petroleum Technology, Distinguished Author Series, 39(8), 25-29, 2000.
Schelkunoff, S.K. and Friis, H.T., "Antennas: Theory and Practice", John Wiley & Sons, Inc., London, Chapman Hall, Limited, pp. 229-244, 351-353, 1952.
Gupta, S.C., Gittins, S.D., "Effect of Solvent Sequencing and Other Enhancement on Solvent Aided Process", Journal of Canadian Petroleum Technology, vol. 46, No. 9, pp. 57-61, Sep. 2007.
"Oil sands." Wikipedia, the free encyclopedia. Retrieved from the Internet from: http://en.wikipedia.org/w/index.php?title=Oil_sands&printable=yes, Feb. 16, 2009.
Sahni et al., "Electromagnetic Heating Methods for Heavy Oil Reservoirs." 2000 Society of Petroleum Engineers SPE/AAPG Western Regional Meeting, Jun. 19-23, 2000.
Power et al., "Froth Treatment: Past, Present & Future." Oil Sands Symposium, University of Alberta, May 3-5, 2004.
Flint, "Bitumen Recovery Technology a Review of Long Term R&D Opportunities." Jan. 31, 2005. LENEF Consulting (1994) Limited.
"Froth Flotation." Wikipedia, the free encyclopedia. Retrieved from the internet from: http://en.wikipedia.org/wiki/Froth_flotation, Apr. 7, 2009.
"Relative static permittivity." Wikipedia, the free encyclopedia. Retrieved from the Internet from http://en.wikipedia.org/w/index/php?title=Relative_static_permittivity&printable=yes, Feb. 12, 2009.
"Tailings." Wikipedia, the free encyclopedia. Retrieved from the Internet from http://en.wikipedia.org/w/index.php?title=Tailings&printable=yes, Feb. 12, 2009.
United States Patent and Trademark Office, Non-final Office action issued in U.S. Appl. No. 12/396,247, dated Mar. 28, 2011.
United States Patent and Trademark Office, Non-final Office action issued in U.S. Appl. No. 12/396,284, dated Apr. 26, 2011.
Patent Cooperation Treaty, Notification of Transmittal of the International Search Report and the Written Opinion of the International Searching Authority, or the Declaration, in PCT/US2010/025808, dated Apr. 5, 2011.

(56) References Cited

OTHER PUBLICATIONS

Deutsch, C.V., McLennan, J.A., "The Steam Assisted Gravity Drainage (SAGD) Process," Guide to SAGD (Steam Assisted Gravity Drainage) Reservoir Characterization Using Geostatistics, Centre for Computational Statistics (CCG), Guidebook Series, 2005, vol. 3; p. 2, section 1.2, published by Centre for Computational Statistics, Edmonton, AB, Canada.
Marcuvitz, Nathan, Waveguide Handbook; 1986; Institution of Engineering and Technology, vol. 21 of IEE Electromagnetic Wave series, ISBN 0863410588, Chapter 1, pp. 1-54, published by Peter Peregrinus Ltd. on behalf of the Institution of Electrical Engineers, © 1986.
Marcuvitz, Nathan, Waveguide Handbook; 1986; Institution of Engineering and Technology, vol. 21 of IEE Electromagnetic Wave series, ISBN 0863410588, Chapter 2.3, pp. 66-72, published by Peter Peregrinus Ltd. on behalf of the Institution of Electrical Engineers, © 1986.
Carlson et al., "Development of the I IT Research Institute RF Heating Process for In Situ Oil Shale/Tar Sand Fuel Extraction—An Overview", Apr. 1981.
A. Godio: "Open ended-coaxial Cable Measurements of Saturated Sandy Soils", American Journal of Environmental Sciences, vol. 3, No. 3, 2007, pp. 175-182, XP002583544.
PCT International Search Report and Written Opinion in PCT/US2010/025772, Aug. 9, 2010.
PCT International Search Report and Written Opinion in PCT/US2010/025763, Jun. 4, 2010.
PCT International Search Report and Written Opinion in PCT/US2010/025807, Jun. 17, 2010.
PCT International Search Report and Written Opinion in PCT/US2010/025804, Jun. 30, 2010.
PCT International Search Report and Written Opinion in PCT/US2010/025769, Jun. 10, 2010.
"Technologies for Enhanced Energy Recovery" Executive Summary, Radio Frequency Dielectric Heating Technologies for Conventional and Non-Conventional Hydrocarbon-Bearing Formulations, Quasar Energy, LLC, Sep. 3, 2009, pp. 1-6.
Burnhan, "Slow Radio-Frequency Processing of Large Oil Shale Volumes to Produce Petroleum-like Shale Oil," U.S. Department of Energy, Lawrence Livermore National Laboratory, Aug. 20, 2003, UCRL-ID-155045.
Sahni et al., "Electromagnetic Heating Methods for Heavy Oil Reservoirs," U.S. Department of Energy, Lawrence Livermore National Laboratory, May 1, 2000, UCL-JC-138802.
Abernethy, "Production Increase of Heavy Oils by Electromagnetic Heating," The Journal of Canadian Petroleum Technology, Jul.-Sep. 1976, pp. 91-97.
Sweeney, et al., "Study of Dielectric Properties of Dry and Saturated Green River Oil Shale," Lawrence Livermore National Laboratory, Mar. 26, 2007, revised manuscript Jun. 29, 2007, published on Web Aug. 25, 2007.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-18.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-33.
Kinzer, A Review of Notable Intellectual Property for In Situ Electromagnetic Heating of Oil Shale, Quasar Energy LLC.
PCT Notification of Transmittal of the International Search Report and the Written Opinion of the International Searching Authority, or the Declaration, in PCT/US2010/025761, dated Feb. 9, 2011.
PCT Notification of Transmittal of the International Search Report and the Written Opinion of the International Searching Authority, or the Declaration, in PCT/US2010/057090, dated Mar. 3, 2011.
"Control of Hazardous Air Pollutants From Mobile Sources", U.S. Environmental Protection Agency, Mar. 29, 2006. p. 15853 (http://www.epa.gov/EPA-AIR/2006/March/Day-29/a2315b.htm).
Von Hippel, Arthur R., Dielectrics and Waves, Copyright 1954, Library of Congress Catalog Card No. 54-11020, Contents, pp. xi-xii; Chapter II, Section 17, "Polyatomic Molecules", pp. 150-155; Appendix C-E, pp. 273-277, New York, John Wiley and Sons.
PCT International Search Report and Written Opinion, Jun. 30, 2010.

* cited by examiner

PRIOR ART

APPARATUS AND METHOD FOR HEATING MATERIAL BY ADJUSTABLE MODE RF HEATING ANTENNA ARRAY

CROSS REFERENCE TO RELATED APPLICATIONS

This specification is related to the following applications, each of which is incorporated by reference herein: U.S. Ser. Nos. 12/396,247; 12/395,995; 12/396,192; 12/396,021; 12/396,284; 12/396,057; 12/395,953, and 12/395,918.

BACKGROUND OF THE INVENTION

The invention concerns heating of materials, and more particularly heating with radio frequency (RF) energy that can be applied to process flows. In particular, this disclosure concerns an advantageous method for RF heating of materials that are susceptible of heating by RF energy by electric dissipation, magnetic dissipation, electrical conductivity and by a combination of two or more of them. In particular, this invention provides a method and apparatus for heating mixtures containing bituminous ore, oil sands, oil shale, tar sands, or heavy oil during processing after extraction from geologic deposits.

Bituminous ore, oil sands, tar sands, and heavy oil are typically found as naturally occurring mixtures of sand or clay and dense and viscous petroleum. Recently, due to depletion of the world's oil reserves, higher oil prices, and increases in demand, efforts have been made to extract and refine these types of petroleum ore as an alternative petroleum source. Because of the high viscosity of bituminous ore, oil sands, oil shale, tar sands, and heavy oil, however, the drilling and refinement methods used in extracting standard crude oil are typically not available. Therefore, bituminous ore, oil sands, oil shale, tar sands, and heavy oil are typically extracted by strip mining, or from a well in which viscosity of the material to be removed is reduced by heating with steam or by combining with solvents so that the material can be pumped from the well.

Material extracted from these deposits is viscous, solid or semisolid and does not flow easily at normal temperatures making transportation and processing difficult and expensive. Such material is typically heated during processing to separate oil sands, oil shale, tar sands, or heavy oil into more viscous bitumen crude oil, and to distill, crack, or refine the bitumen crude oil into usable petroleum products.

Conventional methods of heating bituminous ore, oil sands, tar sands, and heavy oil suffer from many drawbacks. For example, the conventional methods typically add a large amount of water to the materials and require a large amount of energy. Conventional heating methods do not heat material uniformly or rapidly which limits processing of bituminous ore, oil sands, oil shale, tar sands, and heavy oil. For both environmental reasons and efficiency/cost reasons it is advantageous to reduce or eliminate the amount of water used in processing bituminous ore, oil sands, oil shale, tar sands, and heavy oil, and to provide a method of heating that is efficient and environmentally friendly and that is suitable for post-excavation processing of the bitumen, oil sands, oil shale, tar sands, and heavy oil.

RF heating is heating by exposure to RF energy. The nature and suitability of RF heating depends on several factors. RF energy is accepted by most materials but the degree to which a material is susceptible to heating by RF energy varies widely. RF heating of a material depends on the frequency of the RF electromagnetic energy, intensity of the RF energy, proximity to the source of the RF energy, conductivity of the material to be heated, and whether the material to be heated is magnetic or non-magnetic.

RF heating has not replaced conventional methods of heating petroleum ore such as bituminous ore, oil sands, tar sands, and heavy oil. One reason that RF heating has not been more widely applied to heating of hydrocarbon material in petroleum ore is that it does not heat readily when exposed to RF energy. Petroleum ore possesses low dielectric dissipation factors ($\in''$), low (or zero) magnetic dissipation factors ($\mu''$), and low or zero conductivity.

SUMMARY OF THE INVENTION

An aspect of the invention concerns an apparatus for heating a material that is susceptible to RF heating by an RF antenna array. The apparatus includes a source of RF power connected to an antenna array having a plurality of loop antenna sections connected to each other by dipole antenna sections wherein the loop sections and dipole sections create a magnetic near field and an electric near field such that the ratio of magnetic field strength to electric field strength is approximately a predetermined value.

Another aspect of the invention concerns a method of heating a material by RF heating by determining a ratio of RF electric field strength to RF magnetic strength that will heat the material, providing an antenna array having a plurality of loop antenna sections connected to each other by dipole sections wherein the loop sections and dipole sections create a magnetic near field strength and an electric near field strength that approximate the ratio, connecting the antenna array to an RF power source and placing the material within the magnetic and electric near fields of the antenna array.

DETAILED DESCRIPTION OF THE PREFERRED EMBODIMENTS

The present invention will now be described more fully hereinafter with reference to the accompanying drawings, in which one or more embodiments of the invention are shown. This invention may, however, be embodied in many different forms and should not be construed as limited to the embodiments set forth herein. Rather, these embodiments are examples of the invention, which has the full scope indicated by the language of the claims. Like numbers refer to like elements throughout.

RF heating occurs in the reactive near field region of an antenna. The electric and magnetic fields in this region depend on the antenna from which RF energy is emitted.

Figure 1:
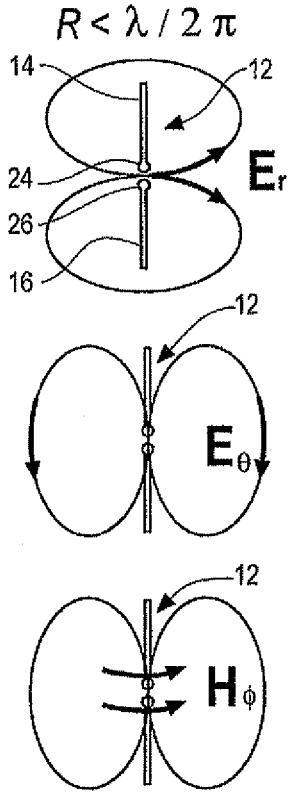
FIG. 1 illustrates the near field electric and magnetic fields of a dipole antenna.

FIG. 1 illustrates the near field region electric (E) and magnetic (H) fields of a dipole antenna 12. The antenna 12 comprises two separate and oppositely extending sections 14 and 16 that are connected to RF energy at connections located at the separation between them, 24 and 26 respectively. The antenna 12 is generally straight and conducts RF energy along its length to create the electric fields, $E_r$ and $E_\theta$, and magnetic field $H_\phi$ in the near field that surrounds the antenna 12. The near field of dipole antenna 12 that provides the most intense heating is the electric field $E_r$.

Figure 2:
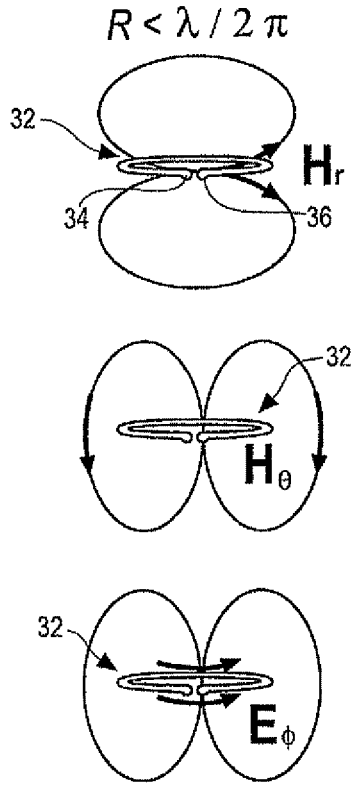
PRIOR ART Fig. 2
FIG. 2 illustrates the near field electric and magnetic fields of a loop antenna.

FIG. 2 illustrates the near field region electric (E) and magnetic (H) fields of a loop antenna 32. The loop antenna 32 conducts RF current around the antenna 32 between connections 34 and 36. The loop antenna 32 creates the electric field $E_\phi$ and magnetic fields $H_r$ and $H_\theta$ in the near field that surrounds the antenna 32. The near field of loop antenna 32 that provides the most intense heating is the magnetic field $H_r$.

Electric fields heat materials that exhibit dielectric dissipation and magnetic fields heat materials that exhibit magnetic dissipation. Materials that are conductive are heated by eddy currents that can be induced by both magnetic and electric fields. Materials are most efficiently heated by RF energy when the strongest fields created by an antenna are fields that most effectively heat the material. For example, conductive material such as water and particularly water mixed with sodium hydroxide is heated by eddy current created by an RF magnetic field. Material that is not conductive but that exhibits dielectric dissipation is heated by RF electric fields. RF heating of a material is most efficient when the RF fields are those to which the material is most susceptible of heating.

Hydrocarbons from geologic formations are poor conductors and heat little by dielectric and magnetic dissipation. RF heating of a mixture containing such hydrocarbons is accomplished by RF heating of other materials in the mixture which heat the hydrocarbons by thermal conduction. RF heating of such mixtures requires providing RF fields that will efficiently heat materials in the mixture that are susceptible to RF heating. Those materials can include material with which hydrocarbons are mixed in the subsurface formation and material that may be added during processing. Copending application having U.S. Ser. No. 12/396,021 discloses heating of hydrocarbons by mixing hydrocarbons with materials that are strongly susceptible to heating by RF energy and that then heat hydrocarbons in the mixture by thermal conduction.

Figure 3:
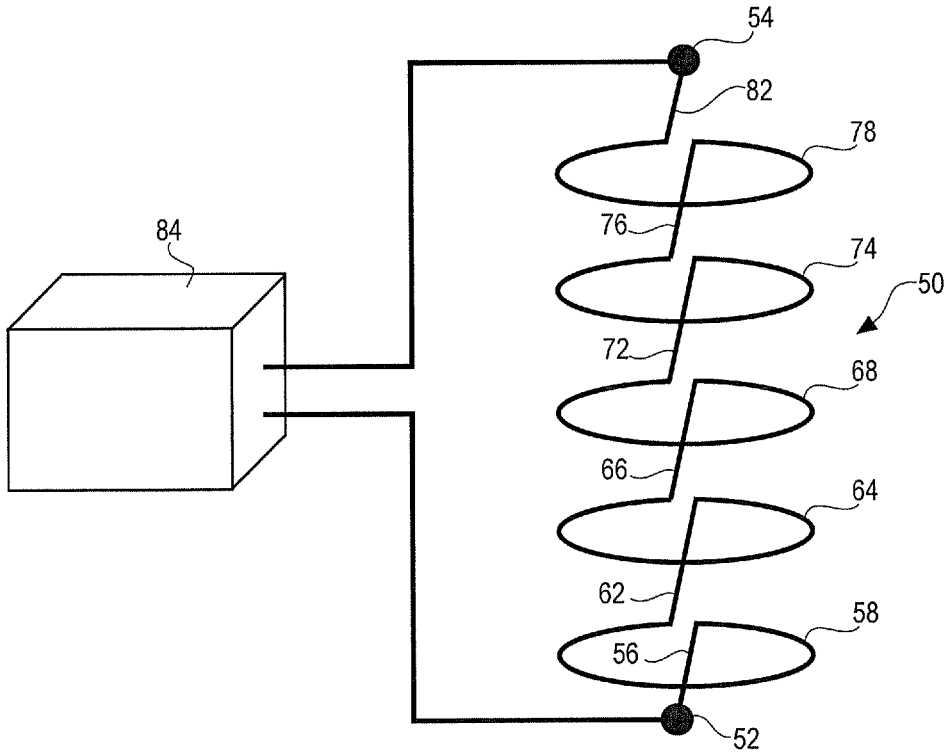
FIG. 3 illustrates an apparatus for heating material by an RF antenna array according to the present invention.

FIG. 3 illustrates an antenna array 50 according to the present invention for RF heating of material that is heated by both magnetic and electric fields. The antenna array 50 extends from connection 52 to connection 54 at which it is connected to an RF energy source 84. The antenna array 50 consists of a series of loop sections 58, 64, 68, 74 and 78 that are connected sequentially to each other by dipole sections 62, 66, 72 and 76. A dipole section 56 connects the connection 52 to the loop 58 and a dipole section 82 connects the loop 78 to the connection 54. The antenna array 50 is connected at connections 52 and 54 to the RF power source 84. The antenna array 50 creates a series of alternating dipole antenna fields and loop antenna fields.

The predominance and strength of the magnetic and electric fields created by the antenna 50 are determined by the dimensions of the dipole sections 56, 62, 66, 72, 76 and 82 and by the number and dimensions of the loop sections 58, 64, 68, 74 and 78. Magnetic field strength of the antenna is increased by increasing the diameter and number of loop sections. Magnetic field strength of the antenna is decreased by providing fewer loop sections and smaller diameter loop sections. Electric field strength is increased by providing longer dipole sections. The ratios of magnetic and electric near field strengths for an antenna array according to the present invention can therefore be determined by configuring the antenna with the needed number and sized loop sections connected by dipole sections.

Figure 4:
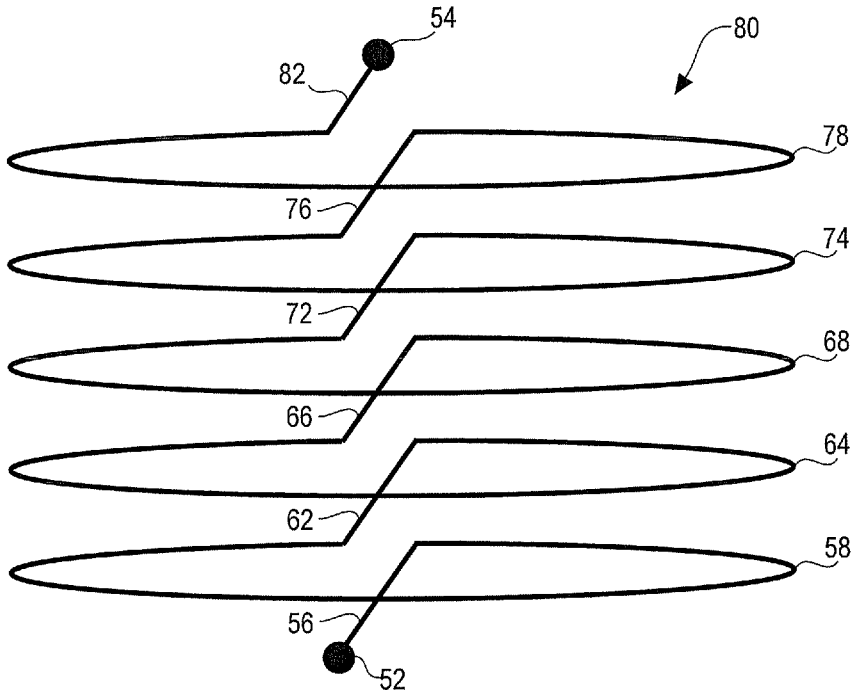
FIG. 4 illustrates an RF antenna array according to the present invention configured to provide strong near field magnetic fields.

FIG. 4 illustrates an antenna 80 according to the present invention for RF heating of material that is heated by both magnetic and electric fields. The antenna 80 extends from connection 52 to connection 54 and consists of a series of loop sections 58,64, 68, 74 and 78 that are connected sequentially to each other by dipole sections 62, 66, 72 and 76. The antenna 80 has the same number of dipole sections and loop sections as antenna 50, but differs from antenna 50 by having shorter dipole sections and larger diameter loops. As compared to antenna 50, the antenna 80 creates larger and higher energy magnetic fields. The antenna 80 would be preferable to the antenna 50 for heating material that is susceptible to heating by magnetic or conductive heating.

Figure 5:
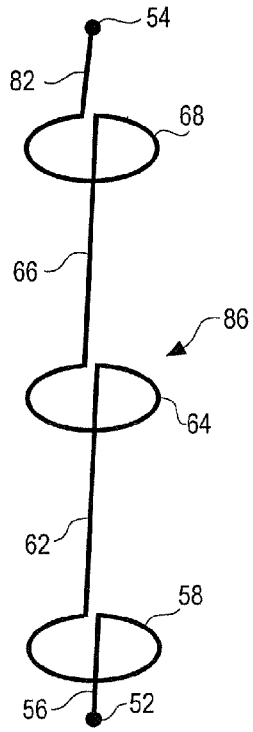
FIG. 5 illustrates an RF antenna array according to the present invention configured to provide strong near field electric fields.

FIG. 5 illustrates an antenna 86 according to the present invention for RF heating of material that is heated by both magnetic and electric fields. The antenna 86 extends from connection 52 to connection 54 and consists of a series of loop sections 58,64, and 68 that are connected sequentially to each other by dipole sections 62 and 66. The antenna 86 has the fewer and longer dipole sections and fewer and smaller loop sections than antenna 50. As compared to antenna 50, the antenna 86 creates smaller and lower energy magnetic fields and a near field in which electric fields predominate. The antenna 86 would be preferable to the antenna 50 for heating material that is susceptible to dielectric heating.

Figure 6:
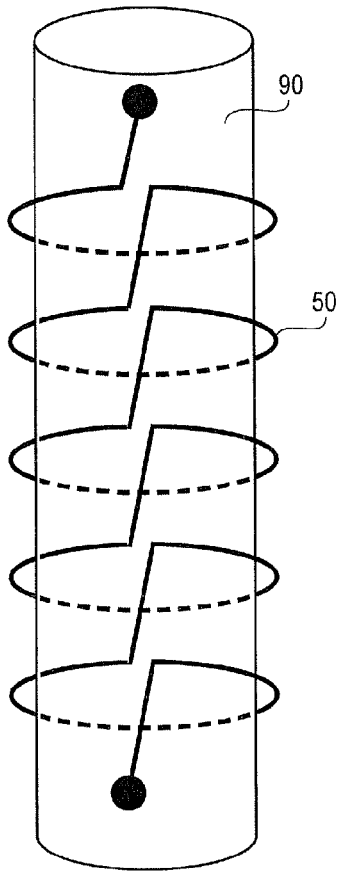
FIG. 6 illustrates the antenna array shown by FIG. 3 surrounding a pipe within which flows a material that is susceptible to RF heating by the antenna array.

FIG. 6 illustrates the antenna array 50 surrounding a pipe 90. A flowable material (not shown) that is susceptible to RF heating passes through the pipe and within the near field electric and magnetic fields created by the antenna array 50. In accordance with the present invention, the antenna array 50 is sized and configured, by the size and number of loop sections and the lengths of the dipole sections, so that connecting the antenna array 50 to an RF power source will produce near field electric and magnetic fields of the antenna array 50 that will heat the material flowing within the pipe 90.

I claim:

1. An apparatus comprising:

an antenna array comprising a plurality of linear dipole antenna sections including a first linear dipole antenna section and a last linear dipole antenna section, and a plurality of parallel loop antenna sections coupled to said plurality of linear dipole antenna sections, with each loop antenna section coupled between adjacent linear dipole antenna sections;

an RF power source coupled to said first and last linear dipole antenna sections and configured to cause said antenna array to generate heat; and a pipe positioned within said plurality of parallel loop antenna sections and configured to receive a flow of a hydrocarbon material in a petroleum ore that is to be heated by said antenna array.

2. The apparatus according to claim 1, wherein a diameter of each loop antenna section is greater than a length of each linear dipole antenna section.

3. The apparatus according to claim 1, wherein a diameter of each loop antenna section is less than a length of each linear dipole antenna section.

4. A method for heating hydrocarbon material in a petroleum ore comprising:

providing an antenna array comprising a plurality of linear dipole antenna sections, and a plurality of parallel loop antenna sections coupled to the plurality of linear dipole antenna sections, with each loop antenna section coupled between adjacent linear dipole antenna sections;

coupling an RF power source to the antenna array so that heat is generated by the antenna array; and positioning a pipe within the plurality of parallel loop antenna sections to receive a flow of the hydrocarbon material in the petroleum ore to be heated by the antenna array.

5. The method according to claim 4, further comprising configuring a diameter of each loop antenna section to be greater than a length of each linear dipole antenna section.

6. The method according to claim 4, further comprising configuring a diameter of each loop antenna section to be less than a length of each linear dipole antenna section.

7. The method according to claim 4, wherein the plurality of linear dipole antenna sections includes a first linear dipole antenna section and a last linear dipole antenna section; and further comprising configuring the RF power source to be coupled to the first and last linear dipole antenna sections.

* * * * *